US010940337B2

(12) United States Patent
Brose et al.

(10) Patent No.: US 10,940,337 B2
(45) Date of Patent: Mar. 9, 2021

(54) TEMPERATURE CONTROL DEVICE AND METHOD FOR ASSEMBLING A TEMPERATURE CONTROL DEVICE FOR HEATING AND/OR COOLING GASES OR GAS MIXTURES, IN PARTICULAR FOR USE IN THE RESPIRATORY PROTECTION SECTOR

(71) Applicant: SATA GmbH & Co. KG, Kornwestheim (DE)

(72) Inventors: Jens Brose, Ottmarsheim (DE); Marco Schönemann, Wendlingen (DE)

(73) Assignee: SATA GMBH & CO. KG, Kornwestheim (DE)

( * ) Notice: Subject to any disclaimer, the term of this patent is extended or adjusted under 35 U.S.C. 154(b) by 54 days.

(21) Appl. No.: 15/678,446

(22) Filed: Aug. 16, 2017

(65) Prior Publication Data

US 2018/0050227 A1 Feb. 22, 2018

(30) Foreign Application Priority Data

Aug. 19, 2016 (DE) ..... 10 2016 009 956.9

(51) Int. Cl.
*A62B 9/00* (2006.01)
*A62B 9/02* (2006.01)
(Continued)

(52) U.S. Cl.
CPC ..... *A62B 9/003* (2013.01); *A62B 9/02* (2013.01); *A62B 9/04* (2013.01); *F25B 9/04* (2013.01)

(58) Field of Classification Search
CPC . A62B 9/003; A62B 9/04; F16B 21/09; F16B 17/004; F25B 9/04; F25B 2309/022
See application file for complete search history.

(56) References Cited

U.S. PATENT DOCUMENTS 3,307,366 A * 3/1967 Smith ..... F25B 9/04 62/5
4,240,261 A * 12/1980 Inglis ..... F25B 9/04 62/5

(Continued)

FOREIGN PATENT DOCUMENTS

CA 2299544 A1 9/2000
CA 2527717 A1 12/2004

(Continued)

OTHER PUBLICATIONS

Office Action dated Apr. 8, 2019 for U.S. Appl. No. 15/678,571.

(Continued)

*Primary Examiner* — Christopher R Zerphey
(74) *Attorney, Agent, or Firm* — Paul D. Bianco; Fleit Intellectual Property Law

(57) ABSTRACT

A temperature control device for heating and/or cooling gases or gas mixtures, in particular for use in the respiratory protection sector. The temperature control device has a housing, a compressed air input, a supply output and a vortex tube with an air inlet, a hot air outlet and a cold air outlet. The vortex tube is installable in at least two final assembly arrangements. In a first arrangement, there is a fluid-conducting connection between the cold air outlet of the vortex tube and the supply output of the temperature control device and, in a second arrangement, there is a fluid-conducting connection between the hot air outlet of the vortex tube and the supply output of the temperature control device. By this configuration, the temperature control device is both a device for heating and cooling respiratory air from mainly the same components with little additional outlay on production and little additional effort during assembly.

24 Claims, 4 Drawing Sheets

(51) Int. Cl.
*A62B 9/04* (2006.01)
*F25B 9/04* (2006.01)

(56) References Cited

U.S. PATENT DOCUMENTS

| | | | | |
|---|---|---|---|---|
| 4,333,754 | A * | 6/1982 | Peter | F25B 9/04 181/403 |
| 4,963,798 | A | 10/1990 | McDermott | |
| 4,973,246 | A * | 11/1990 | Black | A61C 17/0202 433/32 |
| 5,418,419 | A | 5/1995 | McGuire | |
| 5,746,495 | A | 5/1998 | Klamm | |
| 7,679,281 | B2 | 3/2010 | Kim et al. | |
| 7,692,136 | B2 | 4/2010 | Blees et al. | |
| 8,376,574 | B2 | 2/2013 | Spartano et al. | |
| 9,017,440 | B2 * | 4/2015 | Yao | F25B 9/04 55/413 |
| 9,599,372 | B2 * | 3/2017 | Bancroft | A42B 3/286 |
| 10,129,944 | B2 | 11/2018 | Kruse | |
| 2007/0247844 | A1 | 10/2007 | Brass et al. | |
| 2008/0212319 | A1 | 9/2008 | Klipstein | |
| 2009/0147519 | A1 | 7/2009 | Klipstein | |
| 2014/0123978 | A1 * | 5/2014 | Bancroft | F25B 9/04 128/201.23 |
| 2014/0313706 | A1 | 10/2014 | Itoh et al. | |
| 2018/0051860 | A1 | 2/2018 | Maier | |
| 2018/0054866 | A1 | 2/2018 | Kruse | |

FOREIGN PATENT DOCUMENTS

| | | | |
|---|---|---|---|
| CN | 101080594 | A | 11/2007 |
| CN | 201170503 | Y | 12/2008 |
| DE | 1034267 | B | 7/1958 |
| DE | 1708014 | A1 | 4/1971 |
| DE | 2502230 | A1 | 10/1975 |
| DE | 10 2004 043 295 | A1 | 3/2006 |
| DE | 20 2012 104 684 | U1 | 2/2013 |
| DE | 202015005881 | U1 | 11/2015 |
| DE | 10 2014 018 940 | A1 | 6/2016 |
| DE | 102014018940 | A1 | 6/2016 |
| GB | 1427138 | A1 | 3/1976 |
| WO | 2006065589 | A1 | 6/2006 |
| WO | 2016041994 | A1 | 3/2016 |
| WO | 2016096387 | A1 | 6/2016 |

OTHER PUBLICATIONS

German Search Report dated May 2, 2017 for Application No. 20 2016 005 025.8.

German Search Report dated May 19, 2017 for Application No. 10 2016 009 956.9.

German Search Report dated May 2, 2017 for Application No. 20 2016 005 026.6.

Office Action dated Jul. 5, 2018 from U.S. Appl. No. 15/678,571.

Final Office Action dated Jan. 30, 2019 for U.S. Appl. No. 15/678,571.

* cited by examiner

TEMPERATURE CONTROL DEVICE AND METHOD FOR ASSEMBLING A TEMPERATURE CONTROL DEVICE FOR HEATING AND/OR COOLING GASES OR GAS MIXTURES, IN PARTICULAR FOR USE IN THE RESPIRATORY PROTECTION SECTOR

FIELD OF THE DISCLOSURE

The subject matter of the disclosure is a temperature control device for heating and/or cooling gases or gas mixtures, in particular for use in the respiratory protection sector for painters, joiners and varnishers, the temperature control device having a housing, a compressed air input, a supply output and a vortex tube with an air inlet, a hot air outlet and a cold air outlet. Furthermore, the disclosure relates to a method for assembling a temperature control device for heating and/or cooling gases or gas mixtures, in particular for use in the respiratory protection sector, wherein the housing of the temperature control device has at least one basic body with a hot air side and a cold air side, an exhaust air cap, a supply cap and a compressed air input with a locking element.

BACKGROUND

The processing of varnishes or paints generally gives rise to harmful gases and vapors which arise either through the evaporation of solvents and/or the atomization of liquids. In particular, air contaminations of this type arise during atomizing varnishing processes. Accordingly, staying in such a polluted atmosphere is permitted only with suitable respiratory protection measures. These also include, inter alia, respiratory protection apparatuses which can either cover the entire head, as a respiratory protection hood or helmet, or parts of the face, as a half or full mask. Said respiratory protection apparatuses can be designed either so as to be dependent on the environmental air or independent of the environmental air in the form of respiratory protection with forced ventilation. In the varnish processing sector using atomization, use is generally made of respiratory protection masks or hoods with forced ventilation since appropriate regulations greatly limit or do not permit staying in the polluted atmosphere with respiratory protection which is dependent on the environmental air.

In the case of respiratory protection masks with forced ventilation, the air to be breathed in is generally supplied via a compressed air hose, wherein the air is first of all conducted through a multi-stage filter. For sufficient cleaning of the supplied air, use is also made, inter alia, of an activated carbon filter for this purpose. The activated carbon filter is either part of the multi-stage filter system or is carried on the belt by the wearer of the respiratory protection. Moisture can also be supplied to the air via an air humidifier in order to make it easier for the wearer to breath.

In the varnishing trade sector, the compressed air supply generally takes place via air which is sucked up from the surroundings, compressed by a compressor and conducted to the use site via compressed air lines. The compressor is generally followed by a compressed air drier in which the compressed air is cooled down to a low temperature of approx. 3 to 4° C. for drying. The temperature of the compressed air is subsequently generally controlled to a constant temperature, such as, for example, 20° C. If the compressed air is then conducted over a further distance, the influence of the ambient temperature on the temperature of the compressed air greatly increases. For example, a sharp reduction in the temperature takes place if the compressed air lines are laid a great distance under the earth. If the compressed air lines are not shielded over a relatively large distance from the ambient temperature, the ambient temperature also has a great influence on the temperature of the compressed air. In this case, sunshine or a high outside temperature, for example, leads to heating of the compressed air.

If the air supplied to the respiratory protection is too hot or too cold, this may be unpleasant for the wearer of the respiratory protection and may possibly lead to health problems. In certain geographical latitudes, the temperature of the compressed air can thus be heated to significantly below 5° C. or, in other latitudes, to significantly over 40° C. This demonstrates that a temperature control device which is fastened, for example, to the belt of the wearer may improve the wellbeing of the wearer and prevent health problems, such as, for example, a cold.

Temperature control devices in the respiratory protection sector generally operate with what is referred to as a Ranque-Hilsch vortex tube since, apart from the compressed air supply, external energy is not required in order to control the temperature of the respiratory air. In this case, the air to be temperature-controlled is conducted tangentially into a portion of a tube, as a result of which the gas is set into rotation and is divided into an outer hot air flow and an inner cold air flow. The outer hot air flow is then conducted out at the hot air outlet of the vortex tube, and the inner cold air flow is deflected by a deflecting element to the cold air outlet and conducted out there. Depending on whether heating or cooling of the respiratory air is intended to take place, the hot air flow or the cold air flow can be conducted to the respiratory mask. Since, during the separation of the hot air flow and cold air flow in the vortex tube, a loud high-frequency sound arises, it is advantageous, in order to avoid noise nuisance, to conduct the unused gas flow through a sound absorber before the gas flow is conducted away into the environmental air. Sound absorbers of this type are formed according to the prior art by one or more chambers through which the flow passes in series and which generally at least partially surround(s) the vortex tube. However, chambers of this type take up a large amount of space and have a relatively small absorbing effect.

In comparable apparatuses for controlling the temperature of respiratory air, generally only heating of the air flow takes place by separating off a cold air flow with the aid of a vortex tube. However, under certain use conditions, cooling of the respiratory air may also be advantageous for the wearer of the respiratory protection. This is the case, for example, whenever the respiratory protection is supplied with particularly hot air. For this situation, respiratory air coolers are known, with the aid of which the air flow conducted to the respiratory protection can be cooled. Accordingly, it generally depends on the outside temperature and on the influence thereof on the compressed air lines as to whether the respiratory air has to be supplied directly or heated or cooled.

The prior art discloses some devices for controlling the temperature of respiratory air, said devices using a vortex tube for influencing the temperature. For example, a respiratory air heater is disclosed which is arranged in a housing, wherein air is conducted via an air inlet into the housing, is divided there by means of a vortex tube into a cold and a hot air flow, wherein the hot air flow is conducted via a supply output to the breathing unit, and the cold air flow is conducted away out of the housing via an exhaust air output.

In order to regulate the temperature of the hot gas flow, a throttle is provided on the cold air side, via which throttle it is possible to control how much air flows off out of the housing into the surroundings via the exhaust air outlet. By closing the throttle, a reduction in the temperature at the supply output can therefore be obtained since the cold air flow cannot be completely removed from the housing via the exhaust air output and is therefore also conducted out at the supply output. The throttle is adjusted by rotation of one side of the housing relative to the other housing side. In order to ensure that as constant a quantity of air as possible emerges at the supply output, a further throttle is provided which is connected to the first throttle via the rotatable housing side and controls the air quantity which is conducted into the housing via the air inlet. Furthermore, the device comprises a sound absorber through which some of the air flows, said air being conducted out of the housing via the exhaust air output. The sound absorber is formed in this connection from two tube segments which are arranged one inside the other, wherein the air flow has to pass through the cavities between the tube sections first of all in one direction and then in the opposite direction in a labyrinthine manner. For better sound absorption, the tube segments are lined by a sound-deadening material.

SUMMARY

At least some embodiments disclosed provide an improved temperature control device for controlling the temperature of respiratory air, in particular for painters, joiners and varnishers, which temperature control device can be put together with little additional outlay on production both as a respiratory air heater and as a respiratory air cooler from at least for the most part the same components and can be assembled with little effort.

Further advantageous details and refinements are also disclosed and are apparent from the following and the drawing as explained below.

As previously mentioned, the disclosure relates to a temperature control device for heating or cooling gases or gas mixtures, wherein temperature control devices of this type are used in particular in the respiratory protection sector for varnishers, joiners or painters.

Since the temperature control device according to the disclosure is used, inter alia, in varnishing booths or in comparable areas, a housing is preferably provided in order to protect the interior of the temperature control device from soiling by varnishes and paints.

In order to supply compressed air, the housing is provided with a compressed air input via which compressed air is conducted from a compressed air source into the housing. Furthermore, in a preferred refinement, the housing has a supply output via which the temperature-controlled air is conducted out of the housing to a respiratory mask, a respiratory hood or a comparable device, such as, for example, a protective suit. Since it is clear to a person skilled in the art that a respiratory protection mask can also be replaced by another device for supplying respiratory air to the wearer of the temperature control device, corresponding devices should be regarded as synonymous and are not suitable for restricting the scope of protection of the application.

In particular, the temperature control device is a portable temperature control device which can be worn on the body of the user, preferably on a belt around the hips.

Apart from the compressed air input and the supply output, the housing can also have an exhaust air output, wherein that portion of the air flow which, because of its temperature, cannot be used for supplying the wearer of the temperature control device is conducted into the surroundings via the exhaust air output. The exhaust air output therefore constitutes a fluid-conducting connection between the interior of the housing and the surroundings.

In order to control the temperature of the air flow which is conducted via the supply output to the respiratory protection mask or to a comparable device, a vortex tube which operates according to the Ranque-Hilsch principle already described is advantageously provided within the housing. Accordingly, the air is conducted via the compressed air input into the housing and subsequently tangentially into the vortex tube, wherein the air within the vortex tube is set into rotation and a hotter air flow forms on the inside of the vortex tube and a colder air flow forms in the core of the vortex tube. In order to conduct out the two air flows separately, a cold air reflection element which deflects at least large parts of the cold air flow to the cold air end is provided at the hot air outlet of the vortex tube, wherein the hot air flow is largely conducted out via the hot air end. For the same purpose, a hot air reflection element is provided at the cold air end, wherein the hot air flow is largely deflected by the hot air reflection element to the hot air end and the cold air flow is largely conducted out at the cold air end. The hot air flow therefore leaves the vortex tube at the hot air outlet and the cold air flow at the cold air outlet.

Since both a respiratory air heater and a respiratory air cooler are intended to be manufactured with as little additional outlay on production as possible, it is particularly expedient for respiratory air heaters and respiratory air coolers to differ in as few parts as possible, as a result of which considerable savings can be obtained in the manufacturing of the individual parts of the temperature control device. Accordingly, it is particularly expedient to provide a temperature control device in which both a device for respiratory air cooling and a device for respiratory air heating can be assembled from the same parts. This is achieved according to the disclosure in that the vortex tube of the temperature control device can be installed in at least two different final assembly arrangements, wherein the same basic elements are at least substantially used for both arrangements.

The final assembly arrangements differ here to the effect that, in the first final assembly arrangement of the vortex tube, there is a fluid-conducting connection between the cold air outlet of the vortex tube and the supply output of the temperature control device. In contrast thereto, in the case of a second final assembly arrangement, there is a fluid-conducting connection between the hot air outlet of the vortex tube and the supply output of the temperature control device. By means of this change of the arrangement of the vortex tube, the respiratory protection component can be supplied via the supply output with a cold air flow from the cold air outlet of the vortex tube, in the first final assembly arrangement, and with a hot air flow from the hot air outlet of the vortex tube, in the second final assembly arrangement.

In order to facilitate the assembly of the at least two final assembly arrangements, the housing of the temperature control device can consist of a basic body and/or an exhaust air cap and/or a supply cap, wherein the basic body is arranged between the supply cap and the exhaust air cap. It should be noted in this connection that the supply output is attached to the supply cap or is part of the supply cap. Similarly, the exhaust air output is attached to the exhaust air cap or is designed as part of the exhaust air cap. Both the supply cap and the exhaust air cap can consist of one piece or as an assembly of a plurality of individual parts.

Both the supply cap and the exhaust air cap are preferably advantageously manufactured from plastic, wherein the two caps can be configured both differently and identically, or at least identically to a large part, in order to further reduce the production costs. In a preferred refinement, the two caps are manufactured similarly from the point of view of the overall impression, but differ significantly at some points. The supply cap thus has a receptacle for the supply output, at which the supply output can be screwed into the cap. Apart from this, the supply cap can have an opening which is closed with a closure element and via which there is a fluid-conducting connection into the interior of the housing or into the fluid-conducting connection between the vortex tube and the exhaust air outlet. After removal of the closure element, a measuring device can be inserted into the fluid-conducting connection into the interior of the housing in order to measure certain parameters between the vortex tube and the supply output.

In a further preferred exemplary embodiment, the supply cap or the closure element of the supply cap has a receptacle for a color marking, wherein the color of the color marking can be changed in order to be able to differentiate various, possibly structurally identical temperature control devices from one another. By contrast, the exhaust air cap preferably has a receptacle for an adjustment element, wherein the receptacle extends around the exhaust air cap in the lower region of the exhaust air cap. Apart therefrom, the exhaust air cap has an exhaust air output, wherein the exhaust air output can be configured as an elongate cutout in the lower region of the exhaust air cap. Differently than the supply cap which is closed on the upper side, the exhaust air cap is open on its lower side, wherein the opening is closed in the final assembly arrangements by means of the adjustment element and a regulating element.

As already described, the housing of the temperature control device can consist of a plurality of parts, wherein it should be noted that the housing consists at least of a basic body and a supply cap. In this connection, the basic body has a cold air side and a hot air side and, in a first final assembly arrangement, is connected with its cold air side to the supply cap and, in a second final assembly arrangement, is connected with its hot air side to the supply cap. Analogously to the supply cap, the exhaust air cap can also be attached to the basic body. It should be noted in this regard that the housing consists at least of a basic body and an exhaust air cap, wherein the basic body has a cold air side and a hot air side, and, in a first final assembly arrangement, the basic body is connected with its hot air side to the exhaust air cap and, in a second final assembly arrangement, is connected with its cold air side to the exhaust air cap.

Accordingly, the orientation of the housing relative to the supply cap can be changed. It should be noted that the vortex tube is connected to the basic body and the interchanging of the vortex tube outlets takes place by rotation of the basic body through 180°, wherein the orientation of the vortex tube within the basic body does not change. Accordingly, during the assembly, it can be selected whether the basic body is intended to be assembled in a first orientation for a first final assembly arrangement as a respiratory air cooler or in a second orientation for a second final assembly arrangement as a respiratory air heater. The assembly of the temperature control device is therefore considerably facilitated by the possibility of assembling the basic body in two different orientations, since fewer different parts can be assembled always in an identical manner and only the orientation of the basic body has to be adapted. This also has the advantage that costs for the manufacturing of different individual parts and costs for the assembly can be considerably reduced. In order to further facilitate the assembly, for the correct orientation the basic body is provided with at least one assembly marking which shows the correct orientation of the basic body for the corresponding final assembly arrangement. For better understanding, the assembly marking can comprise a symbol which shows which final assembly arrangement is assembled in a certain orientation of the basic body. According to the disclosure, the assembly marking described can be seen only on the basic body and is concealed by part of the supply cap and/or by part of the exhaust air cap in the assembled state.

As has already been explained, it is of advantage if the vortex tube is fastened within the basic body, wherein the vortex tube is at least partially accommodated in the basic body, and the vortex tube is oriented in such a manner that the hot air outlet of the vortex tube is located on the hot air side of the basic body and the cold air outlet of the vortex tube is located on the cold air side of the basic body. In this connection, the vortex tube is connected to the basic body of the temperature control device via a form fit, force fit or adhesive bond. In addition, a sealing element can be provided which is located in the basic body between the vortex tube and the vortex tube receptacle and creates a fluid-tight connection between the vortex tube and the basic body. The sealing element can be, for example, an O ring which extends around a region of the vortex tube, wherein an encircling depression in which the O ring sits and by means of which the O ring can be fixed can be provided in the vortex tube. In addition, further vortex tube receptacles can be provided, wherein it is particularly advantageous if each outlet of the vortex tube is surrounded by a receptacle. In this connection, that outlet of the vortex tube which faces the supply cap is surrounded by an end receptacle and the outlet facing the exhaust air cap is also surrounded by an end receptacle, wherein the end receptacles are pushed into the basic body and fix the outlets of the vortex tube in the basic body. For better sealing, the contact surfaces between the vortex tube and the end receptacles can be provided with sealing elements which prevent air from flowing off between the contact surfaces. Similarly, sealing elements can be provided between the basic body and the end receptacles in order to prevent air from flowing off at the contact surfaces between basic body and the end receptacles. For achieving of the object, it is particularly advantageous if the vortex tube and the basic body are configured in such a manner that the same part is used for both end receptacles. The same part can therefore be installed twice, as a result of which, as already described at a different point, the assembly of the temperature control device can be facilitated and the production costs of the individual parts reduced.

Since, despite the possibility of assembling different final assembly arrangements, the assembly of the temperature control device according to the disclosure is intended to be possible with little effort, the individual parts of the housing are particularly configured for this purpose. The housing of the temperature control device can thus consist of at least two housing parts, wherein the at least two housing parts each have at least one fastening element with a fastening opening, wherein, in the first and in the second final assembly arrangement, the fastening openings of the fastening elements at least partially overlap, and a locking element is provided which extends through the overlapping regions of the two fastening openings and connects the at least two housing parts to each other by means of a form fit. The locking element can be, for example, part of the compressed air input or of another element. This has the advantage that no additional locking element is required, as a result of which both the costs of the production of the individual parts of the temperature control device and the assembly costs are reduced.

As already described, the housing of the temperature control device preferably consists of three housing parts. It is of advantage in this connection if the exhaust air cap and the supply cap each have a fastening element with a fastening opening, and the basic body is arranged between the exhaust air cap and the supply cap and likewise has a fastening opening, wherein the fastening opening of the basic body, the fastening opening of the fastening element of the exhaust air cap and the fastening opening of the fastening element of the supply cap at least partially overlap at least in a first final assembly arrangement and a second final assembly arrangement. In order to connect the basic body, the exhaust air cap and the supply cap to one another, a locking element is provided which extends from the outer side of the housing at least through the overlapping regions of the fastening openings of the exhaust air cap and the supply cap as far as into the fastening opening of the basic body, wherein the locking element is fixable in the fastening opening of the basic body and connects the exhaust air cap, the supply cap and the basic body to one another by means of a form fit. During the connection of the individual parts of the housing, the fixing of the locking element in the basic body can be obtained, for example, by the locking element being screwed into the basic body, wherein it is basically also possible to configure the fixing of the locking element differently, for which purpose a wide variety of connecting possibilities are already known from the prior art.

In order to connect the basic body of the housing to the exhaust air cap and the supply cap, the locking element can be correspondingly configured. It is thus of advantage if the locking element has an elongate anchoring portion with a constant cross section and a circumferential shoulder, wherein the geometry of the cross section of the anchoring portion widens at the shoulder in such a manner that the geometry of the cross section of the shoulder projects in at least one region radially beyond the geometry of the cross section of the anchoring portion. By means of this refinement of the locking element, the assembly of the temperature control device is facilitated to the effect that the shoulder constitutes a stop for the positioning, the stop, for example, preventing the locking element from being screwed too far into the basic body, as a result of which there would be the risk of overtightening the thread or damaging the housing of the temperature control device. If the locking element is not screwed in, but rather is, for example, adhesively bonded in, the positioning of the locking element is also considerably facilitated by means of the shoulder. By means of the shoulder, a clamping force can additionally be produced between the shoulder of the locking element and the basic body, wherein the fastening element of the supply cap and the fastening element of the exhaust air cap are fixed in the region which surrounds the fastening openings by means of a force fit by the clamping force.

Since the assembly of the temperature control device is intended to take place with reduced effort both in a first final assembly arrangement and in a second final assembly arrangement, the locking element is preferably formed by at least part of the compressed air input. This has the advantage that, at least on this side of the housing, no additional element is necessary for fixing the housing parts, since the fixing of the housing parts takes place by means of the compressed air input. It is also advantageous in this refinement that the manufacturing and the purchase costs for at least one further part can be saved, wherein, during the assembly, also only one part instead of at least two parts has to be assembled, as a result of which time and therefore costs are likewise saved.

Since the fixing of the housing parts by means of the compressed air input takes place only on one side of the housing, it is advantageous also to fix the housing parts on the opposite side, wherein it is likewise conceivable, however, for no further fastening to take place on the opposite side of the housing, or for the individual housing parts or the compressed air input to be configured in such a manner that, by means of the fastening of the compressed air input in the basic body, both that side of the housing which faces the compressed air input and that opposite side of the housing parts which faces away from the compressed air input are fixed. However, according to the preferred refinement of the temperature control device, only a fixing of the housing parts on one side by means of the compressed air input is provided. Accordingly, it is of advantage if the supply cap and the exhaust air cap are connected to each other via at least one further part of the temperature control device at least on that side of the temperature control device which faces away from the compressed air input. In this connection, it should be noted that the supply cap and the exhaust air cap can be connected only indirectly to each other on the side facing away from the compressed air input. For example, the connecting plate can serve here as an indirect connection between the two caps.

The connection of the individual housing parts by means of the connecting plate preferably takes place such that both the connecting plate and the basic body have two screw recesses which are spaced apart from each other, and both the supply cap and the exhaust air cap each have a screw recess. Since the temperature control device can be installed in at least two different final assembly arrangements, either the supply cap or the exhaust air cap sits on the cold air side of the basic body, or either the exhaust air cap or the supply cap sits on the hot air side of the basic body. The housing parts are then connected via the connecting plate in such a manner that an upper fastening screw leads through the upper screw recess of the connecting plate and the screw recess of the supply cap, wherein the upper fastening screw is screwed into the corresponding screw recess of the basic body, depending on the orientation of the basic body. In addition, a further lower fastening screw first of all leads through the lower screw recess of the connecting plate and the screw recess of the exhaust air cap, wherein the lower fastening screw is screwed into the corresponding screw recess of the basic body, depending on the orientation of the basic body. Accordingly, the fastening of the individual housing parts takes place both by means of the connection via the compressed air input and also via the fastening via the connecting plate, wherein the connection of the housing parts via the two connections is particularly robust, easy to assemble and cost-effective to realize. Apart therefrom, the described connections make it possible to manufacture the temperature control device particularly compactly and with a low weight since various parts can be omitted or designed in a material-saving manner.

In order to manufacture the temperature control device particularly compactly and with little weight, a central narrowing and a cutout of the housing can also be provided. For this purpose, the housing can be narrowed essentially to the diameter of the vortex tube, at least in the center between the supply cap and the exhaust air cap, wherein the narrowing results in a cutout between the connecting plate of rectilinear design and the narrowed part of the housing. Apart from the saving on weight, this refinement makes it easier to fasten the vortex tube within the basic body since the receptacle for the vortex tube is formed in this refinement by the outer wall of the housing, as a result of which no additional fastening element for the vortex tube is required within the basic body. Apart from the saving on weight and the compact construction, this refinement also achieves a saving on material which leads to a reduction of cost. In addition, the housing of the temperature control device is also configured to be particularly attractive visually by means of the corresponding narrowing.

As mentioned, an exhaust air cap is preferably provided which can be assembled either on the cold air side or the hot air side of the basic body, wherein the exhaust air cap has an exhaust air output which creates a fluid-conducting connection between the interior of the housing and the surroundings, and the cross section of the fluid-conducting connection between the interior of the housing and the surroundings can be reduced and/or expanded at least at one point by means of a throttle valve. In this case, the throttle valve is responsible for regulating the temperature of the air flow which is conducted via the supply output to the respiratory protection component. The temperature here is regulated in such a manner that either the hot air flow is at least partially blocked at the hot air outlet of the vortex tube or the cold air flow is at least partially blocked at the cold air outlet of the vortex tube, wherein only part of the partially blocked air flow can leave the housing of the temperature control device via the exhaust air outlet, and the blocked part of the air flow together with the contrastingly temperature-controlled air flow is conducted at the non-blocked outlet of the vortex tube via the supply output to a respiratory protection mask or a comparable device. Accordingly, by means of the partial closing of the fluid-conducting connection between vortex tube and the surroundings via a throttle valve, a reduction in the efficiency of the vortex tube takes place, or a controllable mixing of the hot and cold air flows within the vortex tube takes place.

With regard to the temperature regulation, it should be mentioned that the temperature of the air flowing off at the supply outlet basically depends on the ratio of the air flow at the exhaust air output to the air flow at the supply output, wherein the ratio can be influenced via the throttle valve. The size of the maximum temperature difference between the temperature of the air flow at the supply output and the temperature of the air flow at the compressed air input depends mainly on the efficiency of the vortex tube and the pressure at which the air is supplied at the compressed air input. Accordingly, in the event of a particularly small portion of temperature-controlled air at the supply output and a particularly large portion of air to be removed at the exhaust air output and a high input pressure, a particularly cold or a particularly hot air flow can be produced at the supply output depending on which outlet of the vortex tube is present at the supply output. Since particularly high or particularly low temperatures may be unpleasant or even dangerous for the wearer of the temperature control device, a temperature sensor which measures the temperature at the supply output can be provided. In addition, it can be provided that, when a certain limit temperature is succeeded or fallen short of, the air flow at the compressed air input and/or the air flow at the exhaust air output are/is influenced in such a manner that the temperature of the supply output after as short a time as possible is again within a range between the limit temperatures or within a range which is safe for the wearer and as far as possible pleasant, or at least approaches such a range. This regulation can take place both electronically and also mechanically, wherein, in the event of a mechanical realization, a bimetal can be used as a temperature sensor and as an actuator for influencing the air flow or the air flows. Both temperature sensors and actuators which can be used instead of a bimetal are already known in various refinements from the prior art.

As mentioned previously, both a first final assembly arrangement and a second final assembly arrangement can be assembled in an advantageous manner from the individual parts of the temperature control device, wherein the supply output can be connected either to the cold air outlet or to the hot air outlet of the vortex tube. The same also applies to the exhaust air outlet, wherein in the first final assembly arrangement, the exhaust air output is connected in a fluid-conducting manner to the hot air outlet of the vortex tube, and, in the second final assembly arrangement, the exhaust air output is connected in a fluid-conducting manner to the cold air outlet of the vortex tube.

As already explained above, the position of the throttle valve has to be changed for a change of temperature at the supply output. In order to configure this particularly easily, an adjustment element is provided. The cross-sectional area of a fluid-conducting connection between the hot air outlet or the cold air outlet of the vortex tube and the surroundings can therefore be changeable directly or indirectly at at least one point by means of the adjustment element, wherein the adjustment element at least partially extends around the housing on the end side, and the cross-sectional area of the fluid-conducting connection can be changed directly or indirectly via rotation of the adjustment element. It should be noted in this connection that the rotation of the adjustment element substantially takes place around the axis of the housing.

In order to make it possible for the wearer of the temperature control device always to select the temperature of the temperature control device identically, or to prevent an inadvertent adjustment of the adjustment element, predefined latching positions can be provided for the adjustment element, wherein, for the adjustment between two adjacent latching positions, a force which initially rises and drops after a certain point has to be overcome. Multiple corresponding rotatable adjustment elements with latching positions are already known from the prior art and, as is known, may differ in design.

The adjustment element furthermore has an indicating element, wherein the indicating element can be felt haptically and, by means of the position of the indicating element, it is possible to perceive at least haptically the extent to which the position of the adjustment element has changed with respect to a basic position. This is particularly important whenever the adjustment element, because of its position, cannot be seen by the wearer and instead only haptically felt. Since the wearer of the temperature control device is generally also wearing a respiratory protection mask or a comparable device which may also restrict the field of view, a targeted adjustment of the air temperature is thereby made possible without removing the respiratory protection mask. The corresponding indicating element can be designed, for example, as an arrow which, by rotation of the adjustment element, changes its position relative to the housing. The adjustment element is particularly preferably formed in a certain color, wherein the color of the adjustment element shows whether the temperature control device has been assembled in a first final assembly arrangement as a respiratory air cooler or in a second final assembly arrangement as a respiratory air heater, as a result of which confusion between respiratory air coolers and respiratory air heaters is avoided. For example, the adjustment element of a first final assembly arrangement as a respiratory air cooler can be designed to be blue and the adjustment element of a second final assembly arrangement as a respiratory air heater can be designed to be red.

Apart from the described features, the adjustment element also preferably has a cutout through which, depending on the rotational position of the adjustment element, the exhaust air output is visible, wherein the air removed through the exhaust air output substantially flows off into the surroundings through the visible region of the exhaust air output and the overlapping region of the cutout. Apart from the function as an outlet element for the air flow which is conducted away into the surroundings via the exhaust air output, the cutout of the adjustment element together with the indicating element also serves as a haptic marking of the rotational position of the adjustment element.

As already described, it is advantageous if the adjustment element is attached to an end side of the temperature control device and at least partially extends around the housing, wherein the adjustment element has, toward the end side of the temperature control device, at least one opening via which the adjustment element is connected to the housing of the temperature control device or to the exhaust air cap by a regulating element. In this case, at least part of the regulating element can be designed as a throttle valve, wherein an adjustment of the throttle valve takes place by interaction of the adjustment element and the regulating element during rotation of the adjustment element. The fastening of the regulating element or of the adjustment element can take place here by means of a snap ring, wherein the adjustment element is first of all pushed onto the front end of the temperature control device, and the regulating element is pushed through the opening of the adjustment element on the housing-remote side into the housing of the temperature control device. Subsequently, the regulating element can be connected to the housing by a snap ring, wherein the snap ring is inserted via the exhaust air outlet and the cutout of the adjustment element into the housing and anchored in the securing position.

In order to prevent the wearer of the temperature control device being annoyed by noises of the outflowing air, the temperature control device can be equipped with a sound absorber, wherein the sound absorber is arranged in the region of the exhaust air cap around the corresponding end of the vortex tube and is composed of a porous material, wherein the air is conducted away into the surroundings via the pores of the material. The sound absorber can be composed here both of a plastic and of other materials, wherein, for example, use can be made of a sintered body made of metal or ceramic.

Apart from the already described features of the temperature control device, the disclosure furthermore relates to an assembly method.

Apart from the previously described features, it is advantageous if an assembly marking which facilitates the assembly of the temperature control device is also provided. The basic body can thus have one or more assembly markings which indicates on the basis of its position and/or configuration how the basic body has to be oriented relative to the other housing parts for assembly of a first final assembly arrangement and how for assembly of a second final assembly arrangement.

The assembly of the compressed air input and the associated assembly of the individual housing parts advantageously takes place in a certain manner. The housing of the temperature control device can thus have a basic body with a hot air side and a cold air side, an exhaust air cap, a supply cap and a compressed air input with a locking element. It should be noted here that the locking element advantageously has an elongate anchoring portion and a circumferential shoulder, wherein the geometry of the cross section of the anchoring portion is expanded at the shoulder in such a manner that the geometry of the cross section of the shoulder projects in one region radially beyond the geometry of the cross section of the anchoring portion. In addition, the exhaust air cap and the supply cap can each have a fastening element with a fastening opening, wherein the basic body preferably likewise has a fastening opening, and, for a first final assembly arrangement, the exhaust air cap is pushed onto the hot air side of the basic body in the direction of the cold air side of the basic body and is oriented in such a manner that the fastening opening of the basic body and the fastening opening of the exhaust air cap are oriented substantially coaxially with respect to each other. This is then followed by the assembly of the supply cap which is pushed onto the cold air side of the basic body in the direction of the hot air side and is oriented in such a manner that the fastening opening of the supply cap is oriented substantially coaxially with respect to the fastening opening of the basic body and the fastening opening of the exhaust air cap. After the substantially coaxial orientation of the fastening openings with respect to one another, the assembly of the locking element then takes place, wherein the locking element can either be assembled as an individual part or as part of the compressed air input, and the assembly takes place in such a manner that the anchoring portion is led through the fastening openings of the supply cap and the exhaust air cap and inserted into the fastening opening of the basic body as far as the shoulder. It should be noted here that the shoulder serves as a stop for the push-in depth of the anchoring portion, and the anchoring portion is anchored in this position in the basic body.

Apart from the fastening of the individual housing parts by means of the compressed air inlet, assembly of the connecting plate also takes place, wherein the connecting plate can likewise serve to fasten the individual parts of the housing. During the assembly of the connecting plate, it should be noted that the housing of the temperature control device can have at least one basic body with a hot air side and a cold air side, an exhaust air cap, a supply cap and a connecting plate, wherein the basic body and the connecting plate preferably each have an upper screw recess and a lower screw recess, and the supply cap has an upper screw recess and the exhaust air cap has a lower screw recess. The assembly of the temperature control device then advantageously takes place in such a manner that, for a first final assembly arrangement, the exhaust air cap is pushed onto the hot air side of the basic body in the direction of the cold air side of the basic body and is oriented in such a manner that the lower screw recess of the basic body and the lower screw recess of the exhaust air cap are oriented substantially coaxially with respect to each other. This is advantageously followed by the assembly of the supply cap, wherein the latter is pushed onto the cold air side of the basic body in the direction of the hot air side of the basic body and is oriented in such a manner that the upper screw recess of the basic body and the upper screw recess of the supply cap are oriented substantially coaxially with respect to each other.

This is then followed preferably by the assembly of the connecting plate which is oriented in such a manner that the upper screw recess of the connecting plate is oriented substantially coaxially with the upper screw recess of the supply cap and the upper screw recess of the basic body, and the lower screw recess of the connecting plate is oriented substantially coaxially with the lower screw recess of the exhaust air cap and the lower screw recess of the basic body. For the fastening of the parts, an upper fastening screw is preferably subsequently screwed into the coaxially oriented upper screw recesses and a lower fastening screw is screwed into the coaxially oriented lower screw recesses, wherein the upper fastening screw connects the basic body, the supply cap and the connecting plate to one another in a form-fitting and/or force-fitting manner, and the lower fastening screw connects the basic body, the exhaust air cap and the connecting plate to one another in a form-fitting and/or force-fitting manner. According to the possible refinement which is described, the exhaust air cap and the supply cap are connected to each other exclusively indirectly via the basic body and the connecting plate, at least in the region of the connecting plate.

As already described, instead of the already described assembly of the first final assembly arrangement, a second final assembly arrangement can preferably likewise be assembled from the components of the first final assembly arrangement, wherein the second final assembly arrangement of the temperature control device differs from the first final assembly arrangement to the effect that the basic body is positioned in such a manner that the exhaust air cap is arranged on the cold air side of the basic body and the supply cap on the hot air side of the basic body. Apart therefrom, the assembly of the second final assembly arrangement advantageously takes place in the manner of the assembly of the first final assembly arrangement, wherein, in the second final assembly arrangement, the hot air side and the cold air side of the basic body are oriented in an opposite manner with respect to the first final assembly arrangement. Owing to the fact that the two final assembly arrangements use the same parts and the assembly of the two final assembly arrangements takes place exactly identically and particularly simply, as seen from the orientation of the basic body, a number of advantages arise in relation to other devices from the prior art. The manufacturing costs of the two final assembly arrangements are therefore reduced by means of the identical parts to the extent that, instead of one product, two different products can be manufactured without considerable additional cost.

As described, the individual parts of the housing of the temperature control device can be connected both via the connecting plate and via the compressed air inlet. In this connection, it is insignificant whether first of all the assembly of the connecting plate or of the compressed air connection takes place. Accordingly, first of all the assembly of the locking element can take place, followed by the assembly of the connecting plate, wherein the substantially coaxial orientation of the screw recesses takes place together with the substantially coaxial orientation of the fastening openings. Secondly, first of all the assembly of the connecting plate can take place, followed by the assembly of the locking element, wherein the substantially coaxial orientation of the fastening openings takes place together with the substantially coaxial orientation of the screw recesses.

BRIEF DESCRIPTION OF THE DRAWINGS

The present disclosure is explained below with reference to the drawings. In the drawings here.

DETAILED DESCRIPTION

Figure 1:
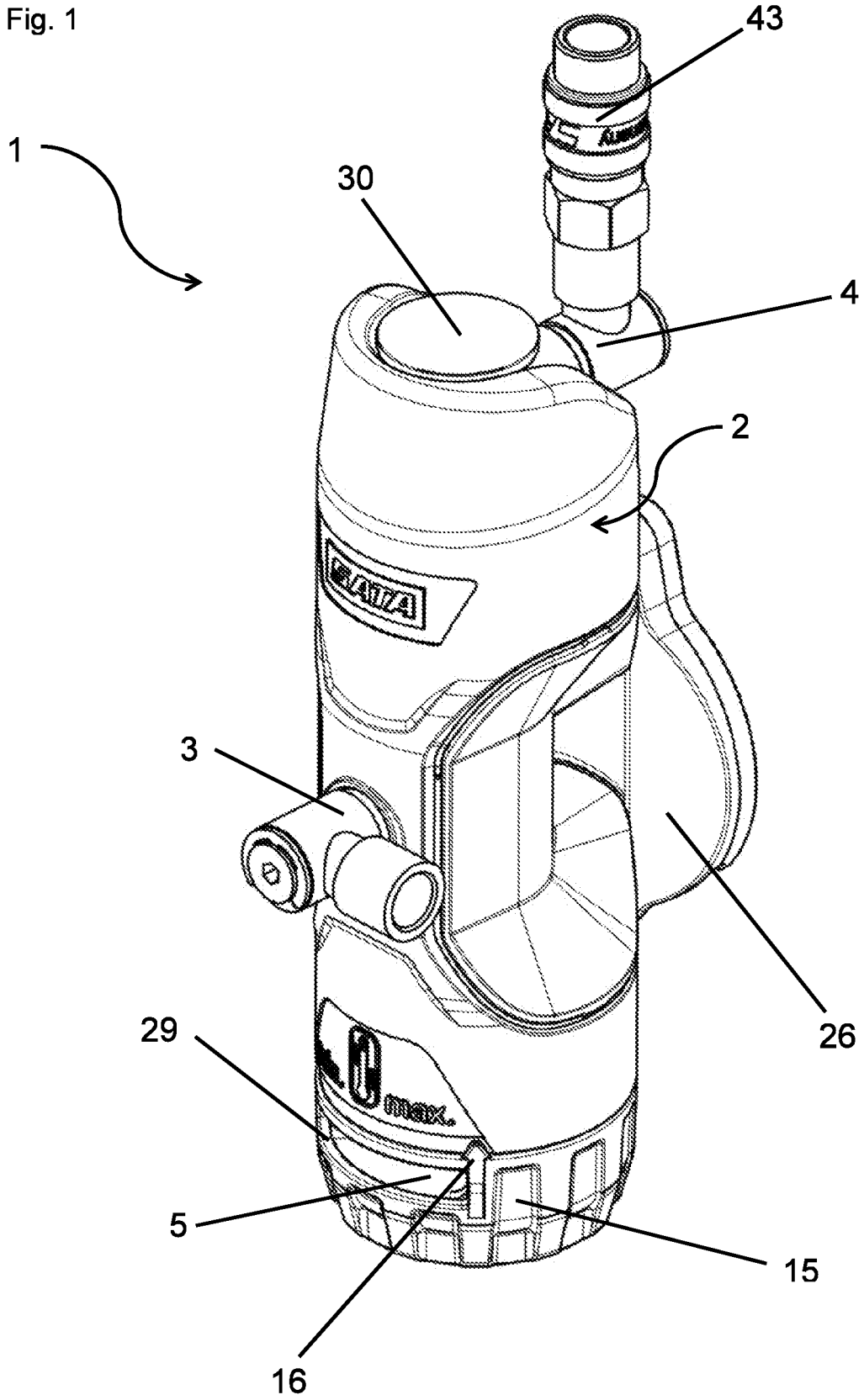
FIG. 1 shows a perspective illustration of an embodiment of a temperature control device according to the disclosure.

FIG. 1 shows a temperature control device 1 for heating and/or cooling gases or gas mixtures, in particular for use in the respiratory protection sector, wherein FIG. 1 shows the temperature control device 1, a housing 2, a compressed air input 3, a supply output 4, an exhaust air output 5, an adjustment element 15 with a cutout 29, an indicating element 16, a connecting plate 26 and a color marking 30. The housing 2 of the temperature control device 1 serves here to protect the parts within the housing 2 against soiling. The compressed air input 3 serves to supply the temperature control device with compressed air, wherein the supply output 4 serves to conduct the temperature-controlled air out of the housing 1 to the respiratory protection component. In addition, the supply output 4 can be provided with a rapid-action coupling 43 via which a connection to a respiratory protection mask or to a comparable device is created.

Figure 2:
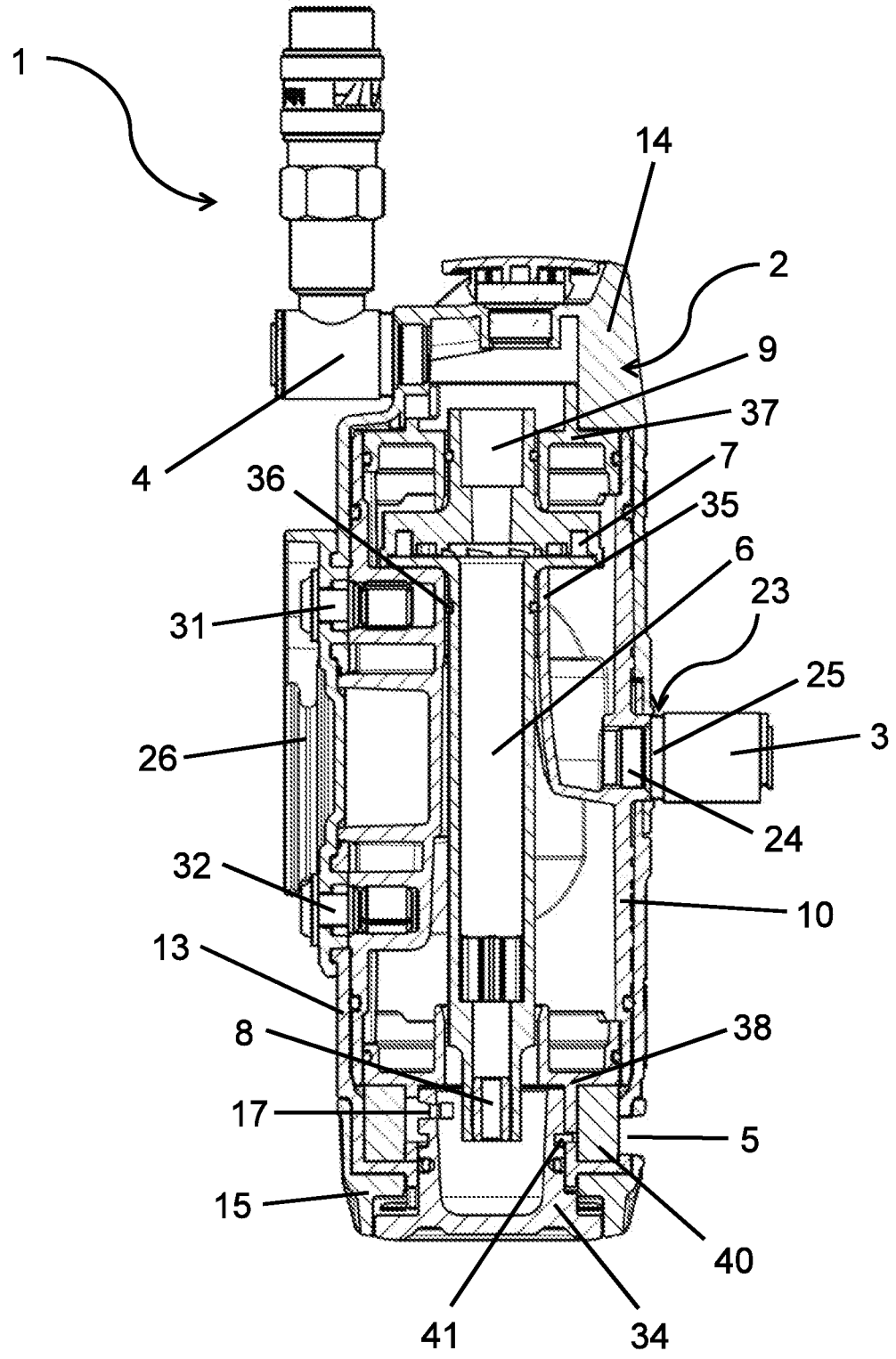
FIG. 2 shows a sectional illustration of a first final assembly arrangement as a respiratory air cooler.
Figure 3:
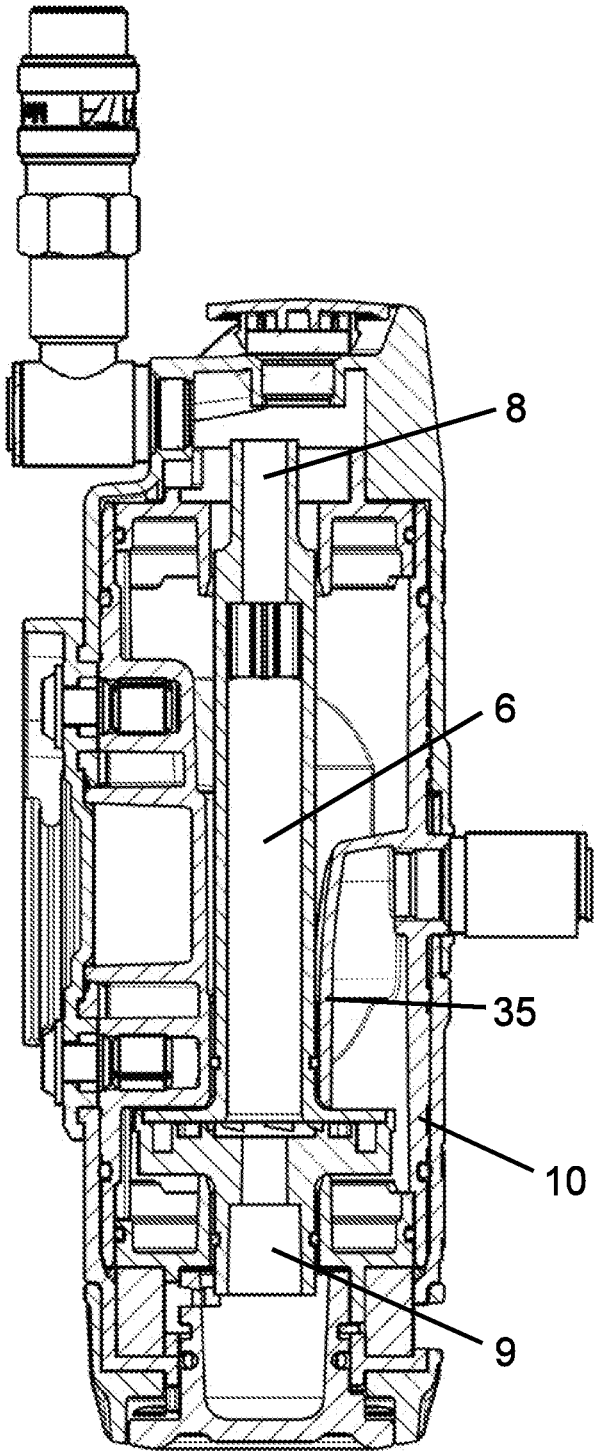
FIG. 3 shows a sectional illustration of a second final assembly arrangement as a respiratory air heater.
Figure 4:
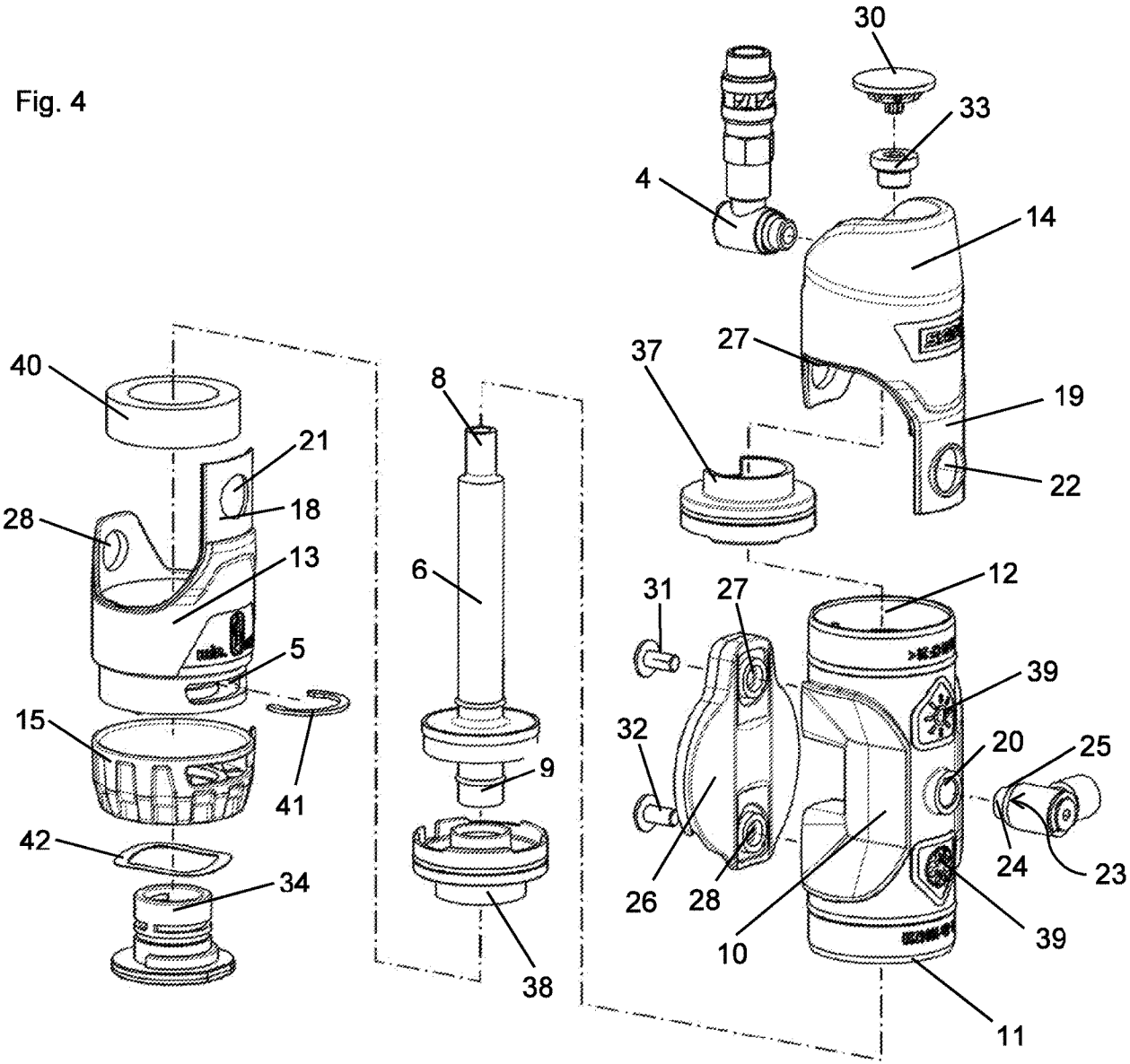
FIG. 4 shows an exploded drawing of a second final assembly arrangement of a temperature control device according to the disclosure.

Furthermore, FIG. 1 shows an exhaust air outlet 5 as part of the exhaust air cap 13 which is illustrated in FIGS. 3 and 4, which exhaust air outlet creates a fluid-conducting connection between the interior of the housing 2 and the surroundings, wherein the cross-sectional area of the fluid-conducting connection between the interior of the housing 2 and the surroundings can be reduced and/or expanded or changed, at least at one point, by means of a throttle valve 17 from FIG. 2.

In addition, FIG. 1 shows an adjustment element 15 via which the cross-sectional area of a fluid-conducting connection between the hot air outlet 8 from FIG. 2 or the cold air outlet 9 from FIG. 2 of the vortex tube 6 from FIG. 2 and the surroundings is changeable directly or indirectly at at least one point, wherein the adjustment element 15 at least partially extends around the housing 2 on the end side, and the cross-sectional area of the fluid-conducting connection is changeable directly or indirectly via rotation of the adjustment element 15. In this connection, the adjustment element 15 like the entire temperature control device 1 can be designed in color in a manner such that the color design directly permits a differentiation to be made between a first final assembly arrangement as a respiratory air cooler and a second final assembly arrangement as a respiratory air heater. Furthermore, it can be seen in FIG. 1 that the adjustment element 15 has an indicating element 16 which can be felt haptically and, by means of the position of the indicating element 16, it is possible to perceive at least haptically the extent to which the position of the adjustment element 15 has changed with respect to a basic position. As can be seen from FIG. 1, the position of the indicating element 16 changes during the rotation of the adjustment element 15, as a result of which the deviation from the basic position can be seen. Even though the indicating element 16 in FIG. 1 is illustrated as an arrow, many other configurations are possible in order to permit the haptic feeling of the indicating element 16. However, the indicating element 16 may also be configured in a manner in which it is not possible to perceive it haptically.

Furthermore, FIG. 1 shows a connecting plate 26 which serves as an additional connecting element of the housing 2.

Apart therefrom, the connecting plate 26 can serve to fasten the temperature control device 1 removably to a belt, wherein a second belt element can be provided to which the connecting plate 26 is releasably fastenable, wherein the belt element is fixedly fastenable to a belt. FIG. 1 also shows that the adjustment element 15 has a cutout 29 through which, depending on the rotational position of the adjustment element 15, the exhaust air output 5 is visible, wherein the air removed through the exhaust air output 5 substantially flows away into the surroundings through the visible region of the exhaust air output 5 and the overlapping region of the cutout 29. In principle, however, the cutout 29 may also be designed in such a manner that the exhaust air output 5 is not visible through the cutout 29. Accordingly, the cutout 29 can also be concealed or at least partially provided with bores or slots, via which the removed air can flow away. It is also readily possible to allow the air also to flow out of the housing 2 at another point and to accordingly offset the cutout 29 or to adapt it in some other way.

A color marking 30 can furthermore be seen in FIG. 1 on the upper side of the temperature control device 1, wherein the color marking 30 is releasably fastened directly or indirectly to the housing 2 and serves to differentiate between two structurally identical temperature control devices 1, wherein a comparable marking may, however, also be provided at a different point of the temperature control device 1.

FIG. 2 likewise shows the temperature control device 1 in a first final assembly arrangement for cooling gases or gas mixtures, in particular for use in the respiratory protection sector, wherein the temperature control device 1 has a housing 2, a compressed air input 3, a supply output 4 and a vortex tube 6 with an air inlet 7, a hot air outlet 8 and a cold air outlet 9, wherein, in this first final assembly arrangement of the vortex tube, there is a fluid-conducting connection between the cold air outlet 9 of the vortex tube and the supply output 4 of the temperature control device 1 and, in a second final assembly arrangement, shown in FIG. 3, there is a fluid-conducting connection between the hot air outlet 8 of the vortex tube 6 and the supply output 4 of the temperature control device 1.

Since one of the vortex tube outlets 8, 9 of the vortex tube 6 is connected in a fluid-conducing manner to the supply output 4 and a vortex tube outlet 8, 9 of the vortex tube 6 is connected in a fluid-conducting manner to the exhaust air output 5, the exhaust air output 5 is accordingly connected in a fluid-conducting manner to the hot air outlet 8 of the vortex tube 6 in the first final assembly arrangement, wherein, in the second final assembly arrangement, the exhaust air output 5 is connected in a fluid-conducting manner to the cold air outlet 9 of the vortex tube 6.

In addition, the already described adjustment element 15 and the throttle valve 17 interacting therewith can be seen from the sectional drawing shown in FIG. 2, wherein the regulating element 34 which is likewise illustrated is connected via the snap ring 41 to the adjustment element and is designed in such a manner that it is rotatable together with the adjustment element. For this purpose, the two parts can be connected to each other via a form fit in such a manner that they are not rotatable counter to one another, wherein a very wide variety of refinement possibilities in this regard are known to a person skilled in the art.

In the refinement illustrated in FIG. 2, the throttle valve 17 is designed as part of the regulating element 34. Accordingly, the adjustment of the throttle valve 17 takes place via the rotation of the regulating element 34 together with the adjustment element 15 relative to the housing 2 of the temperature control device 1. In this connection, the throttle valve 17 can be formed from two slots or recesses shaped in some other way, wherein the two recesses maximally overlap in an open position and minimally overlap in a closed position, and the air flow to be conducted away flows off via the overlapping area of the two recesses. However, a person skilled in the art likewise knows a multiplicity of other solution possibilities in this regard from the prior art.

Furthermore, it is apparent from FIG. 2 that the housing 2 consists at least of a basic body 10 and/or an exhaust air cap 13 and/or a supply cap 14. In addition, a locking element 23 with an anchoring portion 24 and a shoulder 25 can be gathered from FIG. 2, wherein the locking element 23 serves inter alia to connect the housing parts 10, 13, 14 to one another.

Also shown for the connection of the individual housing parts are a connecting plate 26, an upper fastening screw 31 and a lower fastening screw 32 which connect the housing parts 10, 13, 14 of the temperature control device 1 to one another on the side opposite the compressed air input 3.

As further features, FIG. 2 shows a vortex tube receptacle 35 which is formed from part of the basic body 10 of the housing 2 and into which the tubular portion of the vortex tube 6 can be pushed. Since the fluid-conducting connection between the compressed air input 3 and the air inlet 7 of the vortex tube 6 has to be designed to be as fluid-tight as possible, a sealing element 36 is provided between the basic body 10 and the tubular portion of the vortex tube 6 in order to prevent air from flowing away between the vortex tube 6 and the basic body 10.

In order to fix the vortex tube 6 in the basic body 10, FIG. 2 also shows a first and a second end receptacle 37, 38, wherein the two end receptacles 37, 38 are identical and the end receptacles 37, 38 serve to fix the hot air outlet 8 and the cold air outlet 9 of the vortex tube in the basic body. Furthermore, the end receptacles 37, 38 serve to permit sealing between the hot air outlet 8 or cold air outlet 9 of the vortex tube 6 and the basic body 10 so that the air flows emerging from the vortex tube 6 do not slide back into the housing 2. For this purpose, sealing elements can be provided between the outlets 8, 9 of the vortex tube 6 and the end receptacles 37, 38 and between the end receptacles 37, 38 and the basic body 10, via which sealing elements a corresponding sealing is realized at said points. Of course, a different configuration of the end receptacles is likewise possible. For example, the end receptacles can be integrated in part of the housing 2.

As a further element, FIG. 2 shows a sound absorber 40 through which the air flowing away through the downstream exhaust air output 5 flows and which ensures that as far as possible no noise passes to the outside from the interior of the temperature control device 1. In order to permit a particularly compact sound absorber 40, the sound absorber 40 can be composed of an open-pore material, wherein, for this purpose, for example, a corresponding body made from plastic or from another material can be used. For example, the sound absorber 40 can also consist of a sintered body made from a material capable of being sintered.

A particular characteristic of the temperature control device 1 shown in FIG. 2 is how the individual parts of the housing 10, 13, 14 are connected to one another. The housing 2 of the temperature control device 1 basically consists of at least two housing parts 10, 13, 14, wherein the at least two housing parts 10, 13, 14 each have at least one fastening element 18, 19 with a fastening opening 21, 22, wherein, in the first and in the second final assembly arrangement, the fastening openings 21, 22 of the fastening elements 18, 19 at least partially overlap, and a locking element 23 is provided which extends through the overlapping regions of the two fastening openings 21, 22 and which connects the at least two housing parts 10, 13, 14 to each other by means of a form fit.

According to the preferred embodiment depicted in FIG. 2, this is realized in such a manner that the exhaust air cap 13 and the supply cap 14 each have a fastening element 18 and 19 from FIG. 4 with a fastening opening 21, 22 from FIG. 4, and the basic body 10 is arranged between the exhaust air cap 13 and the supply cap 14 and likewise has a fastening opening 20 from FIG. 4 which, at least in the first and in the second final assembly arrangement, at least partially overlaps with the fastening opening 21 from FIG. 4 of the fastening element of the exhaust air cap 18 from FIG. 4 and the fastening opening 22 from FIG. 4 of the fastening element of the supply cap 19 from FIG. 4. Furthermore, a locking element 23 is provided which extends from the outer side of the housing 2 at least through the overlapping regions of the fastening openings of the exhaust air cap 21 from FIG. 4 and the supply cap 22 from FIG. 4 as far as into the fastening opening of the basic body 20 from FIG. 4, wherein the locking element 23 is fixable in the fastening opening of the basic body 20 from FIG. 4 and connects the exhaust air cap 13, the supply cap 14 and the basic body 10 to one another by means of a form fit.

In order to connect the housing parts to one another as described, the locking element 23 has an elongate anchoring portion 24 with a constant cross section and a circumferential shoulder 25, wherein the geometry of the cross section of the anchoring portion 24 is expanded at the shoulder 25 in such a manner that the geometry of the cross section of the shoulder 25 projects in at least one region radially beyond the geometry of the cross section of the anchoring portion 24. It is particularly advantageous here if the locking element 23 is formed by at least part of the compressed air input 3.

As already mentioned previously, apart from the connection via the locking element 23 or via the compressed air input 3, the individual housing parts 10, 13, 14 of the temperature control device 1 are also connected to one another via a second connection opposite the compressed air input. For this purpose, the supply cap 14 and the exhaust air cap 13 can be connected to each other only indirectly via at least one further part of the temperature control device 1 at least on that side of the temperature control device 1 which faces away from the compressed air input 3.

After the description of the individual parts shown in FIG. 2, the operation of the temperature control device 1 will now be explained in more detail with reference to FIG. 2. It should first of all be noted for this purpose that the temperature control device 1 is supplied with compressed air via the compressed air input 3, wherein the supplied air flow flows via the compressed air input 3 into the housing and is conducted there via a fluid-conducting connection into the air inlet 7 into the vortex tube.

In the vortex tube, the air flow, as already described at the beginning of the application, is divided into a cold and a hot air flow, wherein the cold air flow is conducted out of the vortex tube 6 at the cold air outlet 9 of the vortex tube 6 and the hot air flow at the hot air outlet 8. In the first final assembly arrangement shown in FIG. 2, the cold air outlet 9 of the vortex tube 6 is connected in a fluid-conducting manner to the supply output 4, wherein the cold air flow can be conducted from the supply output 4 to a respiratory protection mask (not shown) or a comparable device which supplies the carrier of the temperature control device 1 with uncontaminated air from the temperature control device 1.

Differently than the cold air outlet 9, the hot air outlet 8 is connected in a fluid-conducting manner to the exhaust air output 5, wherein at least some of the hot air flow flows through the sound absorber 40 and the exhaust air output 5 and is subsequently conducted away into the surroundings. In this connection, the opening position of a throttle valve 17 can be influenced via the adjustment element 15, which is connected to the regulating element 34. In accordance with the explanation at the beginning, when the throttle is at least partially closed, some of the hot air flow is conducted back into the vortex tube 6, mixed with the cold air flow and conducted out therewith at the cold air outlet and therefore at the supply output. When the throttle valve 17 is closed, there is therefore virtually no change in temperature at the supply output 4. Since the first final assembly arrangement involves a temperature control device 1 for cooling respiratory air, an increase of the temperature of the air flow at the supply output 4 results from closing the throttle valve 17. On the other hand, when the throttle valve 17 is open to maximum extent, a maximum reduction in temperature of the air flow occurs at the supply output 4.

As mentioned, the temperature control device 1 can be installed in at least two final assembly arrangements, wherein the arrangements differ with reference to the orientations of the basic body 10 to the other housing parts 13, 14 or with reference to the arrangement of the vortex tube outlets 8, 9 with respect to the outputs 4, 5 of the temperature control device 1. The second final assembly arrangement therefore differs from the first final assembly arrangement only to the effect that the vortex tube is connected in a fluid-conducting manner with its hot air outlet 8 to the supply output 4 and with its cold air outlet 9 to the exhaust air output 5. Therefore, in the second final assembly arrangement, when the throttle valve 17 is at least partially closed some of the cold air flow is conducted back into the vortex tube 6, wherein this part of the cold air flow mixes in the vortex tube 6 with the hot air flow and a mixture of the two air flows is conducted out at the supply output 4. Accordingly, in the second final assembly arrangement, the temperature of the air flow conducted out at the supply output 4 can be reduced by at least partially closing the throttle valve 17.

FIG. 3 shows a temperature control device 1 in a second final assembly arrangement for heating gases or gas mixtures, in particular for use in the respiratory protection sector. Accordingly, the different arrangement of the basic body can be seen from FIGS. 2 and 3. Apart from the orientation of the basic body, all of the parts correspond to the parts from FIG. 2. In principle, the temperature control device 1 can be installed in at least two different final assembly arrangements, wherein the basic body 10 in a first orientation and a second orientation is located between the exhaust air cap 13 and the supply cap 14. For this purpose, the basic body 10 has a cold air side 11 and a hot air side 12 and, in a first final assembly arrangement, is connected with its cold air side 11 to the supply cap 14 and, in a second final assembly arrangement, is connected with its hot air side 12 to the supply cap 14. Accordingly, in a first final assembly arrangement, the basic body 10 is connected with its hot air side 12 to the exhaust air cap 13 and, in a second final assembly arrangement, is connected with its cold air side 11 to the exhaust air cap 13. It should be noted that the vortex tube 6 is at least partially accommodated in the basic body 10, wherein the vortex tube 6 is oriented in such a manner that the hot air outlet 8 of the vortex tube 6 is located on the hot air side 12 of the basic body 10, and the cold air outlet 9 of the vortex tube 6 is located on the cold air side 11 of the basic body 10. The connection between the vortex tube 6 and the basic body 10 takes place either via a form fit, a force fit or an adhesive bond, wherein a connection via a force fit is shown in FIGS. 2 and 3.

FIG. 4 shows an exploded drawing of a second final assembly arrangement, wherein the assembly of the temperature control device will be explained in more detail with reference to the illustration. For this purpose, various parts of the temperature control device are shown in FIG. 4. FIG. 4 thus shows a vortex tube 6 with a hot air outlet 8 and a cold air outlet 9. It should be noted in this connection that the vortex tube is constructed from a plurality of parts, but may also consist of one part. In addition the vortex tube can also be adapted for the respective intended use by means of attachment parts or installation parts. For example, a covering can be pressed in at the hot air outlet in order to influence how the air flow is separated within the vortex tube into a hot and a cold air flow. In a departure from the vortex tube illustrated in the drawings, the vortex tube can also be configured differently, wherein a wide variety of refinements of vortex tubes are already known from the prior art.

Furthermore, the basic body 10 of the temperature control device 1 is shown, wherein the basic body 10 shows a cold air side 11 and a hot air side 12, a fastening opening 20 and two assembly markings 39. It should be noted in this connection that the vortex tube 6 is anchored in the basic body 10 in such a manner that the hot air outlet 8 of the vortex tube 6 is located on the hot air side 12 of the basic body 10.

In addition to the anchoring, described in FIGS. 2 and 3, of the vortex tube 6 in the basic body 10, a first end receptacle 37 and a second end receptacle 38 are shown, wherein the outlets 8, 9 of the vortex tube are inserted into the end receptacles 37, 38, as described in FIG. 2. This can also be readily seen from the center line in FIG. 4 which shows how the temperature control device 1 is joined together during the assembly. The end receptacles 37, 38 may also be configured differently here than is visible from the drawings. It is likewise conceivable for the end receptacles 37, 38 to be formed by a different part of the temperature control device 1 so that no additional parts are necessary for fixing the vortex tube outlets 8, 9.

Furthermore, an assembly marking 39 is shown on the basic body 10, said assembly marking serving, on the basis of its position and/or its configuration, to indicate how the basic body 10 has to be oriented relative to the other housing parts 13, 14 for the assembly of a first final assembly arrangement and how for the assembly of a second final assembly arrangement. The at least one assembly marking 39 can be designed here in different ways. For example, a complex illustration with additional information or a simple illustration which consists only of a dot or line can be selected.

As a further housing part, an exhaust air cap 13 and a supply cap 14 are shown, wherein the exhaust air cap 13 has the exhaust air outlet 5, a fastening element 18 with a fastening opening 21 and a lower screw recess 28, and the supply cap 14 has a supply output 4 and also a fastening element 19 with a fastening opening 22 and an upper screw recess 27. Furthermore, a locking element 23 with an anchoring portion 24 and a shoulder 25 is shown, wherein the locking element 23 is designed as part of the compressed air input 3 from FIG. 2 and, during the assembly, is anchored in the basic body 10, for example with a thread.

Apart from the previously described features from FIG. 4, an adjustment element 15, a regulating element 34, a sound absorber 40, a spacer element 42 and a snap ring 41 are furthermore shown. As already mentioned previously, the adjustment element 15 serves to regulate the temperature at the supply output 4 via a rotation of the adjustment element 15 relative to the housing, wherein the rotation takes place substantially about the center axis of the temperature control device 1. For this purpose, the adjustment element 15 is connected directly or indirectly to the regulating element 34 via a force fit, form fit or adhesive bond, wherein the spacer element 42 is placed between the adjustment element 15 and the regulating element 34. The spacer element serves here to create a prestress between the adjustment element 15 and the exhaust air cap 13 and can be designed, for example, as a shaft disk. By means of this prestress, the regulating element 34, which is connected to the exhaust air cap 13 via a snap ring, and the adjustment element 15 are pushed apart very substantially in the direction of the axis of the temperature control device 1, as a result of which a contact pressure is obtained between an inner surface of the adjustment element 15 and a surface of the exhaust air cap 13, in the region of the adjustment element 15. The pressed-together surfaces of the adjustment element 15 and of the exhaust air cap 13 can be provided here in the manner of elevations such that latching positions arise which are detectable during rotation of the adjustment element 15 and hold the adjustment element 15 in the selected position. It should be noted that the fastening of the adjustment element 15 takes place via the spacer element 42 and the regulating element 34, wherein the regulating element 34 is connected to the exhaust air cap 13 via the snap ring 41. The assembly of the adjustment element 15 takes place in such a manner that the adjustment element 15 is first of all pushed from the side facing away from the temperature control device in the direction of the supply cap 14 onto the lower side of the exhaust air cap 13, wherein the spacer element 42 is then inserted into the adjustment element 15 substantially coaxially in the direction of the supply cap 14. The regulating element 34 is subsequently inserted substantially coaxially into the adjustment element 15 and into part of the exhaust air cap 13. After the positioning, the parts are then connected to the exhaust air cap 13 by means of the snap ring 41, wherein the snap ring 41 is inserted via the exhaust air output 5 from FIG. 2 into the exhaust air cap and anchored there.

FIG. 4 likewise shows the color marking 30 which is known from FIG. 1, with the closure element 33, and the closure element 33 is connected to the supply cap 14 of the temperature control device 1 via a thread. The color marking 30 can then be fastened releasably to the closure element 33 via a force fit or form fit.

Since the temperature control device 1 is intended to be assembled, inter alia, with particularly little effort, the assembly of the temperature control device 1 is described in more detail below.

During the assembly of a first final assembly arrangement, first of all the exhaust air cap 13 is pushed onto the hot air side 12 of the basic body 10 in the direction of the cold air side 11 of the basic body 10 and oriented in such a manner that the fastening opening of the basic body 20 and the fastening opening of the exhaust air cap 21 are oriented substantially coaxially with respect to each other. Subsequently, the assembly takes place if the supply cap 14 which is pushed onto the cold air side 11 of the basic body 10 in the direction of the hot air side 12 and oriented in such a manner that the fastening opening of the supply cap 22 is oriented substantially coaxially with respect to the fastening opening of the basic body 20 and the fastening opening of the exhaust air cap 21. After the substantially coaxial orientation of the fastening openings 20, 21, 22, the locking element 23 is assembled, wherein the locking element 23 can be assembled either as an individual part or as part of the compressed air input 3 from FIG. 2, and the assembly takes place in such a manner that the anchoring portion 24 is inserted through the fastening opening of the supply cap 22 and through the fastening openings of the exhaust air cap 21 and into the fastening opening of the basic body 20 as far as the shoulder 25, wherein the shoulder 25 serves as a stop for the push-in depth of the anchoring portion 24, and the anchoring portion 24 is anchored in this position in the basic body 10.

As already described, apart from the connection via the locking element 23 or the compressed air input 3 from FIG. 2, the housing 10 of the temperature control device 1 is also connected via a connecting plate 26 which is likewise illustrated, wherein the connecting plate 26 and the basic body 10 have an upper screw recess 27 and a lower screw recess 28. Furthermore, the supply cap 14 has an upper screw recess 27 and the exhaust air cap 13 has a lower screw recess 28. In addition, an upper fastening screw 31 and a lower fastening screw 32 are provided which are inserted into the corresponding upper screw recess 27 and the corresponding lower screw recess 28 and screwed into the basic body.

The assembly of the connecting plate 26 then takes place in such a manner that the connecting plate 26 is oriented such that the upper screw recess 27 of the connecting plate 26 is oriented substantially coaxially with the upper screw recess 27 of the supply cap 14 and the upper screw recess 26 of the basic body 10, and the lower screw recess 27 of the connecting plate 26 is oriented substantially coaxially with the lower screw recess 28 of the exhaust air cap 13 and the lower screw recess 28 of the basic body 10. After the positioning of the connecting plate 26 and the individual housing parts 10, 13, 14 with respect to one another, an upper fastening screw 31 is screwed into the coaxially oriented upper screw recesses 27 and a lower fastening screw 32 is screwed into the coaxially oriented lower screw recesses 28, wherein the upper fastening screw 31 connects the basic body 10, the supply cap 14 and the connecting plate 26 to one another in a form-fitting manner, and the lower fastening screw 32 connects the basic body 10, the exhaust air cap 13 and the connecting plate 26 to one another in a form-fitting manner. The exhaust air cap 13 and the supply cap 14 are therefore connected to each other exclusively indirectly via the basic body 10 and the connecting plate 26 on the side facing away from the compressed air input 3, at least in the region of the connecting plate 26.

In principle, the assembly of the temperature control device 1 can be begun both with the assembly of the compressed air input 3 or the locking element 23 and also with the assembly of the connecting plate 26, with it being possible, however, for two different final assembly arrangements to be manufactured. In this connection, the assembly of the first final assembly arrangement then takes place in such a manner that the exhaust air cap 13 is pushed onto the hot air side 12 of the basic body 10 in the direction of the cold air side 11 of the basic body 10 and is oriented in such a manner that the lower screw recess 28 of the basic body 10 and the lower screw recess 28 of the exhaust air cap 13 are oriented substantially coaxially with respect to each other. This is then followed by the assembly of the supply cap 14 which is pushed onto the cold air side 11 of the basic body 10 in the direction of the hot air side 12 of the basic body 10 and oriented in such a manner that the upper screw recess of the basic body 10 and the upper screw recess 27 of the supply cap 14 are oriented substantially coaxially with respect to each other. The assembly of the second final assembly arrangement differs from the first final assembly arrangement only to the effect that the basic body 10 is positioned in such a manner that the exhaust air cap 13 is arranged at the cold air side 11 of the basic body 10 and the supply cap 14 on the hot air side 12 of the basic body 10. The assembly of the second final assembly arrangement takes place here in the same manner as the assembly of the first final assembly arrangement, wherein, in the second final assembly arrangement, the hot air side 12 and the cold air side 11 of the basic body 10 are oriented in an opposite manner with respect to the first final assembly arrangement.

As already described, it is irrelevant for the assembly whether first of all the compressed air input 3 with the locking element 23, or the connecting plate 26 is assembled. Accordingly, first of all the assembly of the locking element 23 and then the assembly of the connecting plate 26 can take place, wherein the substantially coaxial orientation of the screw recesses 27, 28 takes place together with the substantially coaxial orientation of the fastening openings 20, 21, 22. On the other hand, the assembly of the connecting plate 26 can also take place first, followed by the assembly of the locking element 23, wherein the substantially coaxial orientation of the fastening openings 20, 21, 22 takes place together with the substantially coaxial orientation of the screw recesses 27, 28.

A preferred exemplary embodiment of the disclosure has been described merely by way of example with reference to the figures. Other constructional forms, materials or types of connections which meet the requirements according to the disclosure are conceivable and are apparent to a person skilled in the art on perusal of the above explanations and the prior art.

What is claimed is:

1. A temperature control device for heating and/or cooling gases or gas mixtures, the temperature control device comprising:

a housing including a basic body and a supply cap, a compressed air input, a supply output, and a vortex tube at least partially accommodated in the basic body, the vortex tube including an air inlet, a hot air outlet, and a cold air outlet, wherein the basic body has a hot air side and a cold air side, the vortex tube being oriented in such a manner that the hot air outlet of the vortex tube is located on the hot air side of the basic body and the cold air outlet of the vortex tube is located on the cold air side of the basic body, the vortex tube of the temperature control device is installable in at least two final assembly arrangements without changing the orientation of the vortex tube within the basic body, in a first final assembly arrangement of the vortex tube, the supply cap is assembled on the cold air side of the basic body with a fluid-conducting connection between the cold air outlet of the vortex tube and the supply output of the temperature control device, and in a second final assembly arrangement of the vortex tube, the supply cap is assembled on the hot air side of the basic body with a fluid-conducting connection between the hot air outlet of the vortex tube and the supply output of the temperature control device.

2. The temperature control device of claim 1,
wherein the housing also includes an exhaust air cap,
the basic body is arranged between the supply cap and the exhaust air cap,
in the first final assembly arrangement, the exhaust air cap is assembled on the hot air side of the basic body, and
in the second final assembly arrangement, the exhaust air cap is assembled on the cold air side of the basic body.

3. The temperature control device of claim 2, wherein the vortex tube is connected to the basic body of the temperature control device via a form fit, force fit or adhesive bond.

4. The temperature control device of claim 1, wherein the basic body and the supply cap each have at least one fastening element with a fastening opening, wherein, in both the first final assembly arrangement and in the second final assembly arrangement, the fastening openings of the fastening elements at least partially overlap, and a locking element is provided which extends through the overlapping regions of the two fastening openings and connects the basic body and the supply cap to each other by a form fit.

5. The temperature control device of claim 2, wherein the exhaust air cap and the supply cap each have a fastening element with a fastening opening, and the basic body likewise has a fastening opening which, at least in the first and in the second final assembly arrangement, at least partially overlaps with the fastening opening of the fastening element of the exhaust air cap and the fastening opening of the fastening element of the supply cap, wherein a locking element is provided which extends from the outer side of the housing at least through the overlapping regions of the fastening openings of the exhaust air cap and the supply cap as far as into the fastening opening of the basic body, wherein the locking element is fixable in the fastening opening of the basic body and connects the exhaust air cap, the supply cap and the basic body to one another by a form fit.

6. The temperature control device of claim 4, wherein the locking element has an elongate anchoring portion with a constant cross section and a circumferential shoulder, wherein a geometry of the cross section of the anchoring portion widens at the shoulder such that a geometry of the cross section of the shoulder projects in at least one region radially beyond the geometry of the cross section of the anchoring portion.

7. The temperature control device of claim 2, wherein the supply cap and the exhaust air cap are only indirectly connected to each other via at least one further part of the temperature control device, at least on a side of the temperature control device which faces away from the compressed air input.

8. The temperature control device of claim 2, wherein the exhaust air cap has an exhaust air output which creates a fluid-conducting connection between the interior of the housing and the surroundings, wherein the cross-sectional area of the fluid-conducting connection between the interior of the housing and the surroundings is changeable at least at one point by a throttle valve.

9. The temperature control device of claim 2, wherein, in the first final assembly arrangement, the exhaust air output is connected in a fluid-conducting manner to the hot air outlet of the vortex tube, and, in the second final assembly arrangement, the exhaust air output is connected in a fluid-conducting manner to the cold air outlet of the vortex tube.

10. The temperature control device of claim 1,
wherein an adjustment element is provided via which the cross-sectional area of a fluid-conducting connection between the hot air outlet or the cold air outlet of the vortex tube and the surroundings is directly or indirectly changeable at at least one point,
the adjustment element is attached to one end of the housing of the temperature control device, and
the cross section of the fluid-conducting connection is directly or indirectly changeable via rotation of the adjustment element.

11. The temperature control device of claim 10, wherein the adjustment element has an indicating element which can be felt haptically so that the extent the position of the adjustment element has changed with respect to a basic position is determinable at least haptically.

12. The temperature control device of claim 10, wherein the adjustment element has a cutout through which, depending on the rotational position of the adjustment element, the exhaust air output is visible, wherein the air removed through the exhaust air output substantially flows off through the visible region of the exhaust air output and the overlapping region of the cutout into the surroundings.

13. A method for assembling the temperature control device of claim 1, the method comprising arranging the basic body of the housing between the supply cap and an exhaust air cap.

14. The method for assembling a temperature control device of claim 13, wherein the basic body has at least one marking which indicates based on at least one of a position of the at least one marking and a configuration of the at least one marking how the basic body should be oriented relative to the supply cap and the exhaust air cap for assembly of the first final assembly arrangement and for assembly of the second final assembly arrangement.

15. The method for assembling a temperature control device of claim 13, wherein the housing has a compressed air input with a locking element, wherein the locking element has an elongate anchoring portion and a circumferential shoulder, wherein the geometry of the cross section of the anchoring portion widens at the shoulder in such a manner that the geometry of the cross section of the shoulder projects in at least one region radially beyond the geometry of the cross section of the anchoring portion, wherein the exhaust air cap and the supply cap each have a fastening element with a fastening opening, and the basic body has a fastening opening, wherein, for the first final assembly arrangement, the exhaust air cap is pushed onto the hot air side of the basic body in the direction of the cold air side of the basic body and is oriented in such a manner that the fastening opening of the basic body and the fastening opening of the exhaust air cap are oriented substantially coaxially with respect to each other, wherein the assembly of the exhaust air cap is followed by the assembly of the supply cap which is pushed onto the cold air side of the basic body in the direction of the hot air side and is oriented in such a manner that the fastening opening of the supply cap is oriented substantially coaxially with respect to the fastening opening of the basic body and the fastening opening of the exhaust air cap, wherein, after the substantially coaxial orientation of the fastening openings with respect to one another, the assembly of the locking element takes place, wherein the locking element can be mounted either as an individual part or as part of the compressed air input, and the assembly takes place in such a manner that the anchoring portion is guided through the fastening openings of the supply cap and of the exhaust air cap and introduced in the fastening opening of the basic body as far as the shoulder, wherein the shoulder serves as a stop for the push-in depth of the anchoring portion, and the anchoring portion is anchored in this position in the basic body.

16. The method for assembling a temperature control device of claim 13, wherein the housing has a connecting plate, wherein the basic body and the connecting plate each have an upper screw recess and a lower screw recess, and the supply cap has an upper screw recess and the exhaust air cap has a lower screw recess, wherein the assembly takes place in such a manner that, for the first final assembly arrangement, the exhaust air cap is pushed onto the hot air side of the basic body in the direction of the cold air side of the basic body and is oriented in such a manner that the lower screw recess of the basic body and the lower screw recess of the exhaust air cap are oriented substantially coaxially with respect to each other, wherein the assembly of the exhaust air cap is followed by the assembly of the supply cap which is pushed onto the cold air side of the basic body in the direction of the hot air side of the basic body and is oriented in such a manner that the upper screw recess of the basic body and the upper screw recess of the supply cap are oriented substantially coaxially with respect to each other, wherein subsequently the assembly of the connecting plate takes place which is oriented in such a manner that the upper screw recess of the connecting plate is oriented substantially coaxially with the upper screw recess of the supply cap and with the upper screw recess of the basic body, and the lower screw recess of the connecting plate is oriented substantially coaxially with the lower screw recess of the exhaust air cap and the lower screw recess of the basic body, wherein subsequently an upper fastening screw is screwed into the coaxially oriented upper screw recesses and a lower fastening screw is screwed into the coaxially oriented lower screw recesses, wherein the upper fastening screw connects the basic body, the supply cap and the connecting plate to one another in a form-fitting manner, and the lower fastening screw connects the basic body, the exhaust air cap and the connecting plate to one another in a form-fitting manner, wherein the exhaust air cap and the supply cap are connected to each other exclusively indirectly via the basic body and the connecting plate, at least in the region of the connecting plate.

17. The method for assembling a temperature control device of claim 15, wherein, instead of the assembly of the first final assembly arrangement, a second final assembly arrangement can be assembled from the components of the first final assembly arrangement, wherein the second final assembly arrangement of the temperature control device differs from the first final assembly arrangement to the effect that the basic body is positioned in such a manner that the exhaust air cap is arranged at the cold air side of the basic body and the supply cap is arranged on the hot air side of the basic body, wherein the assembly of the second final assembly arrangement takes place in the manner of the assembly of the first final assembly arrangement, wherein, in the second final assembly arrangement, the hot air side and the cold air side of the basic body are oriented in an opposite manner with respect to the first final assembly arrangement.

18. The method for assembling a temperature control device of claim 16, wherein first the assembly of the locking element takes place, followed by the assembly of the connecting plate, wherein the substantially coaxial orientation of the screw recesses takes place jointly with the substantially coaxial orientation of the fastening openings.

19. The method for assembling a temperature control device of claim 16, wherein first the assembly of the connecting plate takes place, followed by the assembly of the locking element, wherein the substantially coaxial orientation of the fastening openings takes place jointly with the substantially coaxial orientation of the screw recesses.

20. A method for assembling the temperature control device of claim 1, the method comprising:

arranging the basic body of the housing between the supply cap and an exhaust air cap, wherein the arranging comprises at least one of:

pushing the exhaust air cap onto the hot air side of the basic body and pushing the supply cap onto the cold air side of the basic body, so as to form the first final assembly arrangement, and pushing the exhaust air cap onto the cold air side of the basic body and pushing the supply cap onto the hot air side of the basic body, so as to form the second final assembly arrangement.

21. The temperature control device of claim 20, wherein orientation of the basic body relative to the supply cap and the exhaust air cap differs in the first and second configurations.

22. A temperature control device for heating and/or cooling gases or gas mixtures, the temperature control device comprising:

a housing including a basic body and a supply cap, a compressed air input, a supply output, and a vortex tube at least partially accommodated in the basic body, the vortex tube including an air inlet, a hot air outlet, and a cold air outlet, wherein the basic body has a hot air side and a cold air side, the vortex tube being oriented in such a manner that the hot air outlet of the vortex tube is located on the hot air side of the basic body and the cold air outlet of the vortex tube is located on the cold air side of the basic body, the vortex tube of the temperature control device is installable in at least two final assembly arrangements without changing the orientation of the vortex tube within the basic body, in a first final assembly arrangement of the vortex tube, the supply cap is assembled on the cold air side of the basic body with a fluid-conducting connection between the cold air outlet of the vortex tube and the supply output of the temperature control device, and in a second final assembly arrangement of the vortex tube, the supply cap is assembled on the hot air side of the basic body with a fluid-conducting connection between the hot air outlet of the vortex tube and the supply output of the temperature control device, the orientation of the vortex tube hot air and cold air outlets to the supply cap is different between the first final assembly arrangement and the second final assembly arrangement, the basic body and the supply cap each have at least one fastening element with a fastening opening, wherein, in both the first final assembly arrangement and the second final assembly arrangement, the fastening openings of the fastening elements at least partially overlap, and a locking element is provided which extends through the overlapping regions of the two fastening openings and connects the basic body and the supply cap to each other by a form fit, and the locking element is formed by at least one part of the compressed air input.

23. A temperature control device for controlling temperature of gases or gas mixtures, the temperature control device comprising:

a housing including a basic body and a supply cap, a compressed air input, a supply output, and a vortex tube at least partially accommodated in the basic body, the vortex tube having an air inlet, a hot air outlet, and a cold air outlet, wherein the basic body has a hot air side and a cold air side, orientation of the supply cap relative to the hot air side and the cold air side of the basic body can be changed so that the vortex tube is installable in at least first and second configurations without changing the orientation of the vortex tube within the basic body, in the first configuration, the supply cap is connected to the cold air outlet of the vortex tube, and in the second configuration, the supply cap is connected to the hot air outlet of the vortex tube.

24. The temperature control device of claim 20, wherein the housing also includes an exhaust air cap, orientation of the exhaust air cap relative to the hot air side and the cold air side of the basic body can also be changed, in the first configuration, the exhaust air cap is connected to the hot air outlet of the vortex tube, and in the second configuration, the exhaust air cap is connected to the cold air outlet of the vortex tube.

* * * * *